United States Patent [19]

Swapceinski et al.

[11] 4,173,405

[45] Nov. 6, 1979

[54] DEVELOPER DISTRIBUTION APPARATUS

[75] Inventors: John P. Swapceinski, Bergen; Thomas K. Hilbert, Spencerport; James A. McGlen, Rochester, all of N.Y.

[73] Assignee: Eastman Kodak Company, Rochester, N.Y.

[21] Appl. No.: 847,382

[22] Filed: Oct. 31, 1977

[51] Int. Cl.[2] ..... G03G 15/00

[52] U.S. Cl. ..... 355/3 DD; 118/657; 222/DIG. 1

[58] Field of Search ..... 355/3 DD, 3 SH, 3 BE; 118/7, 656–658; 427/18; 222/DIG. 1

[56] References Cited

U.S. PATENT DOCUMENTS

| | | | |
|---|---|---|---|
| 3,246,629 | 4/1966 | Shelffo et al. | 118/658 |
| 3,894,510 | 7/1975 | Eto | 118/656 X |
| 4,044,719 | 8/1977 | Ohmori | 355/3 DD |

*Primary Examiner*—R. L. Moses

*Attorney, Agent, or Firm*—Raymond L. Owens

[57] ABSTRACT

In an electrographic development apparatus having a magnetic brush and a sump wherein an auger transports developer from the sump to the brush, the auger being disposed in a tube located next to an inclined surface extending between the tube and the magnetic brush. The tube is provided with a plurality of openings. As the auger rotates it transports developer from the sump through the tube out of its opening to the inclined surface where it is distributed to the magnetic brush.

4 Claims, 4 Drawing Figures

DEVELOPER DISTRIBUTION APPARATUS

CROSS-REFERENCE TO RELATED APPLICATIONS

Reference is made to commonly assigned co-pending U.S. patent application Ser. No. 558,522, entitled: Toner Handling Apparatus, filed on Mar. 14, 1975 in the names of Katusha et al now issued as U.S. Pat. No. 4,062,385.

BACKGROUND OF THE INVENTION

1. Field of the Invention

The invention relates to magnetic brush development apparatus, and more particularly, to apparatus for distributing developer to magnetic brushes.

2. Description of the Prior Art

In electrography, it is common to form an electrostatic image on an insulating surface of an electrophotographic member in the form of a drum or web and to develop that image by applying toner particles thereto. In many commercial applications, the toner is either transferred in an image-wise configuration to another surface and then fixed or is fixed to the insulating surface itself. In processes in which the toner is transferred from the insulating surface prior to fixing, the insulating surface generally is reused.

Triboelectric developing systems are frequently used in the development of electrostatic images. In such systems, finely divided toner particles are held to the surface of much larger carrier particles by electrostatic charges created by triboelectrification, forming a mixture (herein called a developer). When the developer is brought into contact with an electrostatic image, the charge on the image attracts the triboelectrically charged toner away from the carrier thereby developing the image.

Among triboelectric developing systems, the most commonly used are cascade systems and magnetic brush systems. In cascade systems, gravity is used to roll developer across the image. Because cascade systems use gravity as their primary moving force, they are necessarily speed limited. In automatic machines, a cascade recirculation system generally requires substantial machine space.

In magnetic brush systems, the carrier particles are ferromagnetic in nature. These ferromagnetic carrier particles are held to an applicator surface, for example, a rotatable nonmagnetic cylinder, in a bristle formation, by magnets located inside the cylinder. The bristles are brushed across a surface carrying an electrostatic image. The electrostatic attraction between the toner and the electrostatic image overcomes the triboelectrically created attraction between toner and ferromagnetic particles and the image is developed. Areas of the image exerting less attractive force on the toner than is exerted by the carrier are cleaned on toner as they are brushed.

In one form of magnetic brush development apparatus, measured amounts of toner are added in a sump to the developer to maintain a proper developer mixture of toner and carrier (magnetic) particles. The toner is folded into the developer mixture by feed and return augers and a mixing wheel. The feed auger moves the developer from the sump through a passageway into a development station wherein the magnetic brush(s) is disposed. The return auger moves developer from the station back through a passageway into the sump. With this type of development apparatus it is important that developer be uniformly distributed to the magnetic brush surface. If the developer is not uniformly distributed, developed images may contain areas that are over developed (too much toner) or under developed (two little toner).

SUMMARY OF THE INVENTION

In accordance with the invention, there is provided a development apparatus wherein developer is moved by at least one rotatable auger from a sump to a development station. The development station includes a magnetic brush. The auger is disposed in a tube which is in communication with the sump. Openings are provided in the tube. As the auger rotates it transports developer from the sump through the tube and, by means of openings in the tube, delivers it to an inclined surface which distributes it relatively uniformly to the magnetic brush, thus assuring the uniformity of image development.

DESCRIPTION OF THE PREFERRED EMBODIMENT

Figure 1:
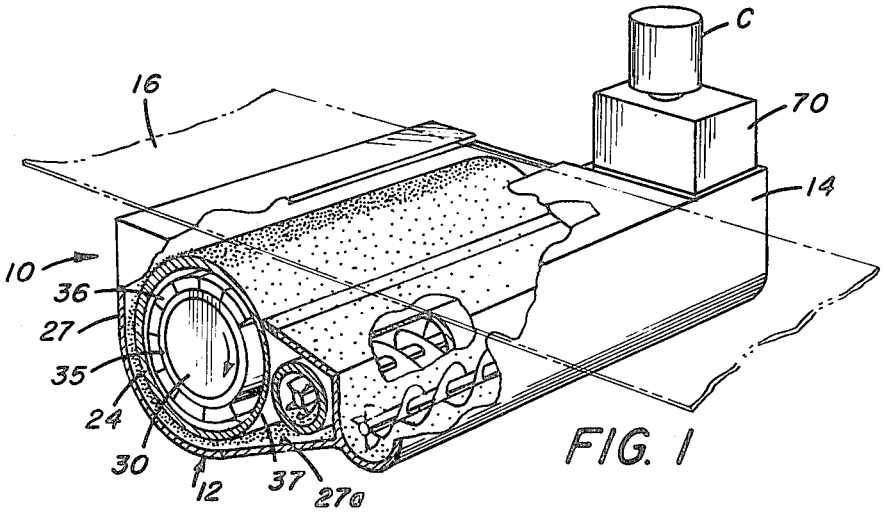
FIG. 1 is a perspective view of a development apparatus having a development station and a sump which embodies the invention.
Figure 2:
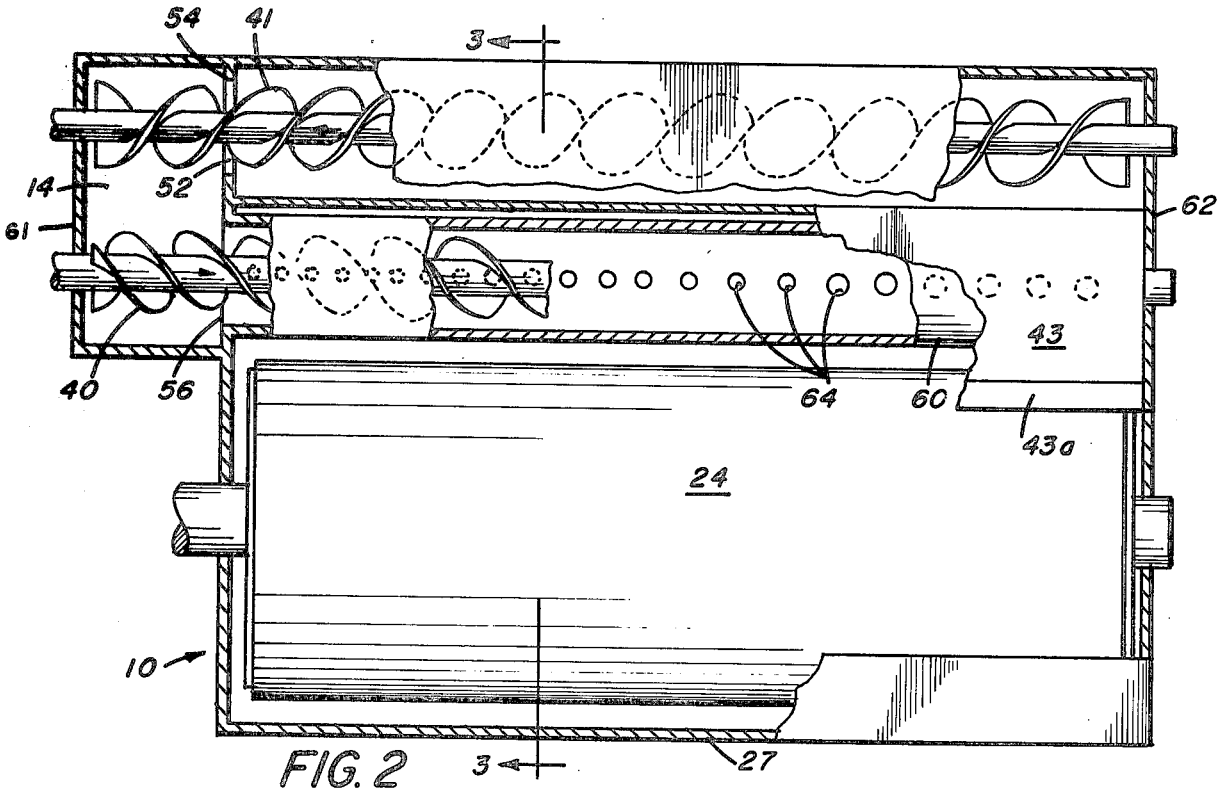
FIG. 2 is a partial top plan view of the development apparatus of FIG. 1 showing the arrangement of augers and magnetic brush.
Figure 3:
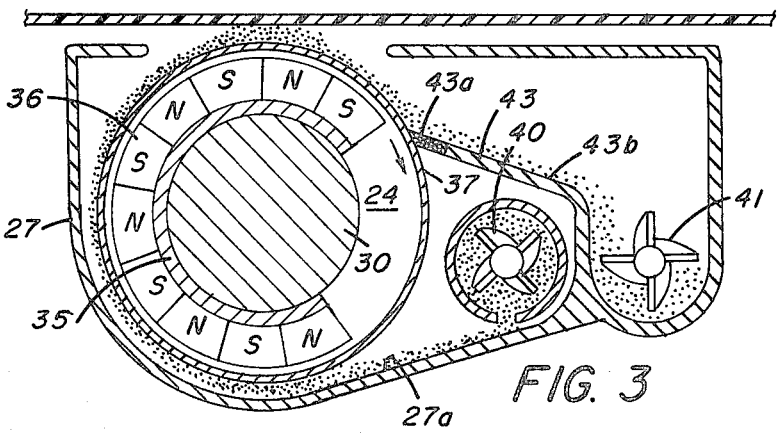
FIG. 3 is a schematic cross-sectional representation of the development station portion of the development apparatus taken substantially along line 3—3 of FIG. 2.
Figure 4:
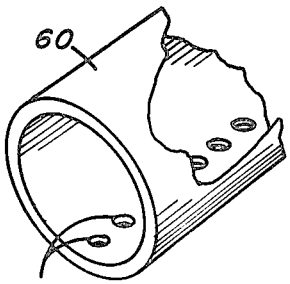
FIG. 4 is an enlarged partial perspective view of the toner distribution tube shown in all the above Figs.

Referring to FIGS. 1–3 there is shown a development apparatus 10 which includes a development station 12 and a sump 14 (See FIGS. 1 and 2). The development apparatus 10 uses a developer, which is a mixture of toner and carrier particles.

As shown in FIG. 1, an electrostatic charge pattern is carried on an insulating surface of a moving electrophotographic member in the form of a web 16. Often this electrophotographic web is referred to in the art as a photoconductor or a film. The web 16 is moved past a magnetic brush 24 mounted in a housing 27. The brush can be constructed according to any of a variety of designs known in the art. According to FIG. 3, a preferred design for this application includes a stationary core 30 of nonmagnetic material around which is mounted a stationary magnetic pole piece 35 that may be made of soft steel or other magnetic material. Mounted around part of the circumference of the pole piece 35 is a series of permanent magnets 36, for example, rubber bonded barium ferrite magnetic strips or poles. Concentric with the arrangement of these elements and on the outside thereof is a rotatable, preferably grooved, nonmagnetic roller 37. As the roller 37 rotates, developer is held on its surface and moved with the roller while in the field of the magnets 36.

The stationary magnets 36 attract the developer to the roller 37. The magnetic field from the magnets 36 causes the developer to coat the roller surfaces so that they appear like a fine-bristled brush. It is the surface of this coating which actually touches the web 16 to supply toner to the charged image area.

In developing the copy image, toner is constantly removed from the developer and carried away on the film for later transfer to copy paper. The carrier granules are retained in the developer for reuse. Within the development station 12 are also disposed feed and return augers 40 and 41 respectively. These augers will be described more fully later in this specification. It should be noted, that a skive 43 strips off a portion of the developer from the roller 37 and directs it to the return auger 41. More specifically the skive 43 is formed at its end 43*a* of a relatively flexible material such as hard rubber which is in engagement with the roller 37 and strips developer off of it. The skive 43 as best shown in FIG. 3 forms an inclined surface 43*b*. Developer removed from the roller 37 flows under the influence of gravity downwardly along the surface 43*b* until it is delivered to the return auger 41.

The sump 14 shown in FIG. 2 is disposed near the ends of brush 24 at one end of the development station 12. The sump 14 contains a mixing wheel (not shown) and end portions of the augers 40 and 41 which mechanically mix or fold the toner into the developer as it is added into the developer. For a more detailed description of a somewhat similar development station, reference may be made to commonly assigned U.S. Pat. No. 3,543,720 issued Dec. 1, 1970 in the names of Drexler et al.

Both of the Augers 40 and 41 are elongated helical members which may be made of molded plastic or from metal such as cast aluminum or other nonmagnetic material. The feed auger 40, is located near the bottom center of the development station 12 and the sump 14. From the sump, the auger 40 moves the developer through a passageway 56 formed in a wall 54 from the sump 14 to the development station 12. The auger 40 rides in sealed bearings (not shown) at extreme end walls 61 and 62 of the sump 14 and station 12 respectively and is driven by the gear train (not shown). For an example of such a gear train see FIG. 2 of the abovementioned U.S. Pat. No. 3,543,720. In the station 12, the auger 40 is disposed in a close fitting concentric relation within a tube 60.

The tube 60 is in direct communication with the sump 14 by means of passageway 56. The other end of the tube 60 is closed by a wall 62 of the station 12. As shown in FIGS. 1 and 2, openings 64 are provided in the bottom of the tube 60. It has been found to be preferable to make these openings in the form of cylindrical holes. The openings are disposed in close proximity to an inclined surface 27*a* of the housing 27. Developer distributed from the openings is deposited onto the surface 27*a* and under the influence of gravity flows downwardly into proximity with the roller 37. As the developer flows out of the openings it drops into the inclined surface 27*a* and spreads somewhat laterally. Thereafter, it flows down the inclined surface and is evenly distributed to the roller 37. The rotating roller 37, under the influence of the magnets 36, picks up the developer and moves it up to engagement with the film 16 as discussed above. By having the wall 62 close one end of the tube 60 and placing holes 64 at intervals along the bottom of the tube, the developer discharge is distributed from the holes in the tube to the surface 27*a* and then to the magnetic brush 24.

In one development apparatus that was built and tested a relatively uniform distributed flow to the surface of the magnetic brush 24 was achieved over an auger RPM range of 350 to 600 RPM. The holes in the tube were subdivided into eight groups, with the holes in each group having a specific diameter.

The test unit consisted of a: 0.937" O.D., 19.38" long, auger having a pitch of 2.75 inches with four flutes and a 1.00" I.D. tube with a pattern of cylindrical discharge openings or holes given below in Table 1. The developer used included a carrier having polymer (plastic) coated iron granules having a diameter of approximately 100 microns and a toner having finely ground particles of a black pigment and polymer compound having a diameter of about from 5 to 20 microns. A substantially uniform distribution through each opening was obtained. Table 1 sets forth the group member, number of openings in each group and the diameter of the holes in each group.

| Group | No. of Holes | Hole Diameter (inches) |
|---|---|---|
| 1 | 9 | .093 |
| 2 | 9 | .096 |
| 3 | 14 | .014 |
| 4 | 14 | .101 |
| 5 | 11 | .111 |
| 6 | 11 | .113 |
| 7 | 20 | .116 |

In designing any given developer station in accordance with this invention, the diameter of the tube, the size and number of its openings, characteristics of the particulate developer (including toner concentration) being pumped as well as auger: RPM, diameter, flute depth and flute pitch should be carefully selected to provide a substantially uniformly developer discharge through each of the openings 64 to the inclined surface 27*a*.

The return auger 41 (see FIGS. 1 and 2) is at the bottom right of the development station 12 and the sump 14. It moves the developer from the station to the sump through a passageway 52 in the wall 54. The return auger rides in sealed bearings (not shown) at the walls 61 and 62 respectively.

A conventional toner replenishment mechanism 70 (shown only as a block) is mounted above and is secured to the top of the sump 14. The mechanism 70 is fed toner from a replaceable container C. The mechanism 70 adds measured amounts of toner to the developer in the sump 14 to maintain a proper concentration of toner and carrier particles. An example of such a mechanism and a container C is set forth in Commonly Assigned U.S. Pat. No. 4,062,385, issued Dec. 15, 1977 to Katusha et al.

The combined motion of the roller 37 and augers 40 and 41 circulates the developer. Starting in the sump 14, the developer is transported by the feed auger 40 from the sump into the tube 60 and uniformly distributed out of the holes 64 to the surface 27*a* where it flows downwardly to the magnetic brush 24. The carrier particles are attracted to the magnets 36 inside the magnetic brush 24. As the developer contacts the roller 37, it is carried into contact with the web 16 at the top of the magnetic brush 24.

As previously mentioned, the flexible end 43*a* of the skive plate 43 strips the developer from the roller 37 and directs it to the return auger 41 by way of the inclined surface 43*b*. The return auger 41 moves some of the developer once again to the sump 14.

Any developer remaining on the roller 37 continues to move until it reaches a position where there are no magnets 36 next to it. The developer now drops off of the roller 37 and falls onto the surface 27*a* where it is mixed with the developer delivered through the holes 64.

The invention has been described in detail with particular reference to a preferred embodiment thereof, but it will be understood that variations and modifications can be effective within the spirit and scope of the invention as described hereinabove and as defined in the appended claims.

We claim:

1. A developer distribution apparatus for use with a development apparatus having a sump for receiving developer and a development station including a magnetic brush, comprising:

(a) an elongated tube disposed in said development station;

(b) means defining an inclined surface extending downwardly from below said tube to a position adjacent to said magnetic brush;

(c) a rotatable auger mounted within said tube for transporting developer from said sump along said tube; and (d) said tube defining at least three openings of different sizes disposed adjacent to said inclined surface, such that as said auger rotates, developer is transported from said sump through said tube and drops through said tube openings to said inclined surface where it moves downwardly under the influence of gravity to be distributed to said magnetic brush.

2. The invention as set forth in claim 1 wherein said openings are cylindrical holes and wherein the size of the diameters of said holes increases in the direction of developer transported by said auger.

3. In electrographic development apparatus including a development station where toner particles are removed during development, from developer having toner and carrier particles and at least one rotating auger for mixing toner and carrier particles and for transporting developer to said development station, the improvement comprising:

(a) a member disposed in said development station adjacent to said auger for supporting the developer as it is transported by said auger and having at least three openings of different sizes arranged so that developer transported by said rotating auger flows through said openings; and (b) surface defining means disposed in said development station under said openings, said surface extending laterally and sloping downwardly so that developer flowing through said openings engages said surface, spreads laterally on said surface, moves downwardly under the influence of gravity, and is evenly distributed.

4. The invention as set forth in claim 3 wherein the size of said openings increases in the direction of developer transported by said auger.

* * * * *